US005379274A

United States Patent [19]

Lee

[11] Patent Number: 5,379,274

[45] Date of Patent: Jan. 3, 1995

[54] INCLINATION ADJUSTING MEANS FOR A LIQUID-ORNAMENTAL DESK CLOCK

[76] Inventor: Vincent K. W. Lee, No. 44, Lane 458, Sheh Chung Street, Taipei, Taiwan, Prov. of China

[21] Appl. No.: 237,928

[22] Filed: May 4, 1994

[51] Int. Cl.[6] ..... G04B 37/00; A47G 29/00

[52] U.S. Cl. ..... 368/317; 248/371

[58] Field of Search ..... 368/88, 276, 277, 278, 368/316-317; 248/133, 139, 371, 398

[56] References Cited

U.S. PATENT DOCUMENTS

| | | | |
|---|---|---|---|
| 2,746,237 | 5/1956 | Anderson | 368/317 |
| 4,527,149 | 7/1985 | Swensen | 340/365 R |
| 4,935,394 | 4/1988 | Fallo | 248/653 |
| 5,072,330 | 12/1991 | Fuqua | 368/316 |
| 5,238,146 | 8/1993 | Hornes, Jr. | 221/1 |

*Primary Examiner*—Vit W. Miska
*Attorney, Agent, or Firm*—Bacon & Thomas

[57] ABSTRACT

An inclination adjusting means for a liquid-ornamental desk clock, and more particularly to an inclination adjusting means for a liquid-ornamental desk clock of which the dial is shown by means of reflection. The inclination adjusting means of the present invention includes a movable cover plate having a grooved rack held between two springy arms, and a receiving portion having a springy and toothed middle section to receive the rack therein. The engagement of the toothed middle section of the receiving portion with the grooved rack of the movable cover plate allows the cover plate to be freely adjusted and fixed to different angles relative to the desk clock and thereby inclines the same to show time indication at the best viewing angle.

3 Claims, 5 Drawing Sheets

INCLINATION ADJUSTING MEANS FOR A LIQUID-ORNAMENTAL DESK CLOCK

BACKGROUND OF THE INVENTION

Conventionally developed liquid-contained ornaments mostly present changes in the inner view provided by the flowing liquid and in the outer formation of the ornament ifself. Attempts have been made to combine such liquid-contained ornament with a desk clock to form a so-called Liquid-Ornamental Desk Clock. A simplified liquid-ornamental desk clock includes a small electronic clock directly adhered to a liquid-contained ornament, directly providing the consumer or user both a changeful flowing liquid view and the time indication. This simple liquid-ornamental desk clock usually has rough appearance and has a dial which blocks the beautiful view provided by the liquid. There is also much finely designed liquid-ornamental desk clock which includes a desk clock attached to a base of the liquid ornament, the dial and accordingly the time indication of the desk clock is reflected on an outer surface of the liquid-contained ornament by means of refraction and reflection provided by the liquid and the curved glass container surface of the ornament, respectively. Such finely designed liquid-ornamental desk clock has substantially met the requirement of most consumers and is widely accepted and adored by them. This type of liquid-ornamental desk clock is, however, not adjustable in its inclination which is usually set by the manufacturer during the production and therefore, fails to fully extend it function to some users of different heights or at different viewing angles that are inconsistent with the reflection and refraction angles set for the liquid-ornamental desk clock by the manufacturer. Sometimes, the user has to adjust the inclination of the entire liquid-ornamental desk clock to show the time indication within his or her visual field by means of inserting some thing under the latter. Such manner of inclination adjustment is surely inconvenient and annoying to the user and has largely affected the esthetics and accordingly the practical value of the liquid-ornamental desk clock.

SUMMARY OF THE INVENTION

It is therefore a primary object of the present invention to provide an inclination adjusting means for a liquid-ornamental desk clock. Such inclination adjusting means is simple in its structure and operation while it allows free inclination adjustment of the desk clock to maximize the practical effect thereof.

Another object of the present invention is to provide the above inclination adjusting means for a liquid-ornamental desk clock, in which a cover plate with a rack containing multiple grooves is provided to engage with a toothed member fixed to a base of the desk clock, permitting the cover plate to be freely swung relative to the fixed toothed member, and thereby, the desk clock can be positioned at different inclination angles and the time indication and changeful flowing liquid can be viewed from different positions.

A further object of the present invention is to provide the above inclination adjusting means for a liquid-ornamental desk clock, in which the cover plate serves at the same time as a gate of an access hole of the power-supply compartment of the desk clock.

To achieve the above objects, the present invention is provided on a bottom floor of the power-supply compartment of the liquid-ornamental desk clock, and mainly includes a movable cover plate containing at one side a horizontally disposed rack, and an internally toothed receiving member fixedly mounted on the bottom floor of the desk clock. The rack engages with the toothed receiving member such that the latter functions as a hinge about it the movable cover plate can be pivotly swung to either fitly close the access hole of the power-supply compartment or to be fixed at a certain desired angle to support the liquid-ornamental desk clock at a desired inclination.

DETAILED DESCRIPTION OF THE PREFERRED EMBODIMENT

Figure 1:
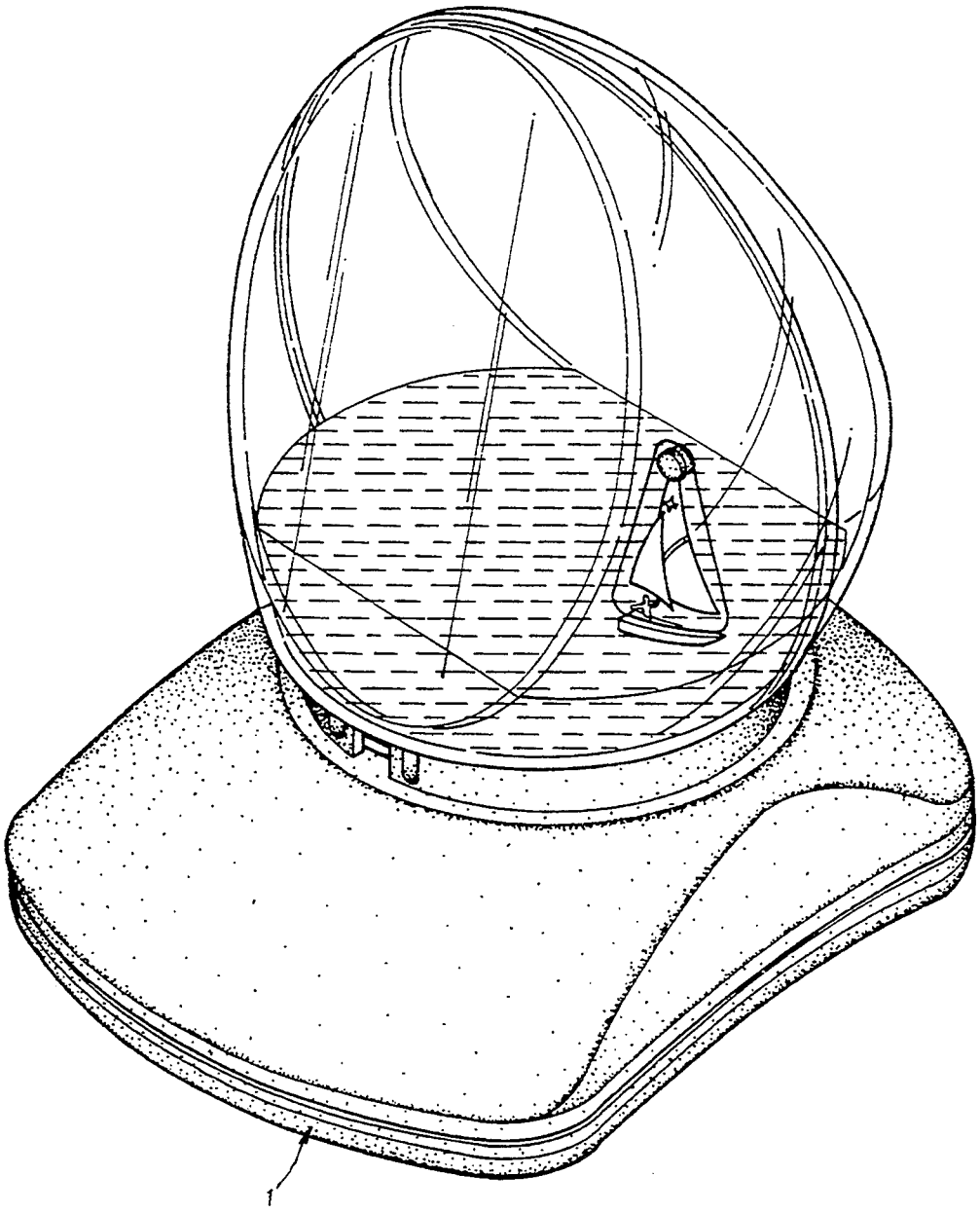
FIG. 1 is a perspective view of an embodiment of a liquid-ornamental desk clock to which the inclination adjusting means of the present invention is provided.
Figure 2:
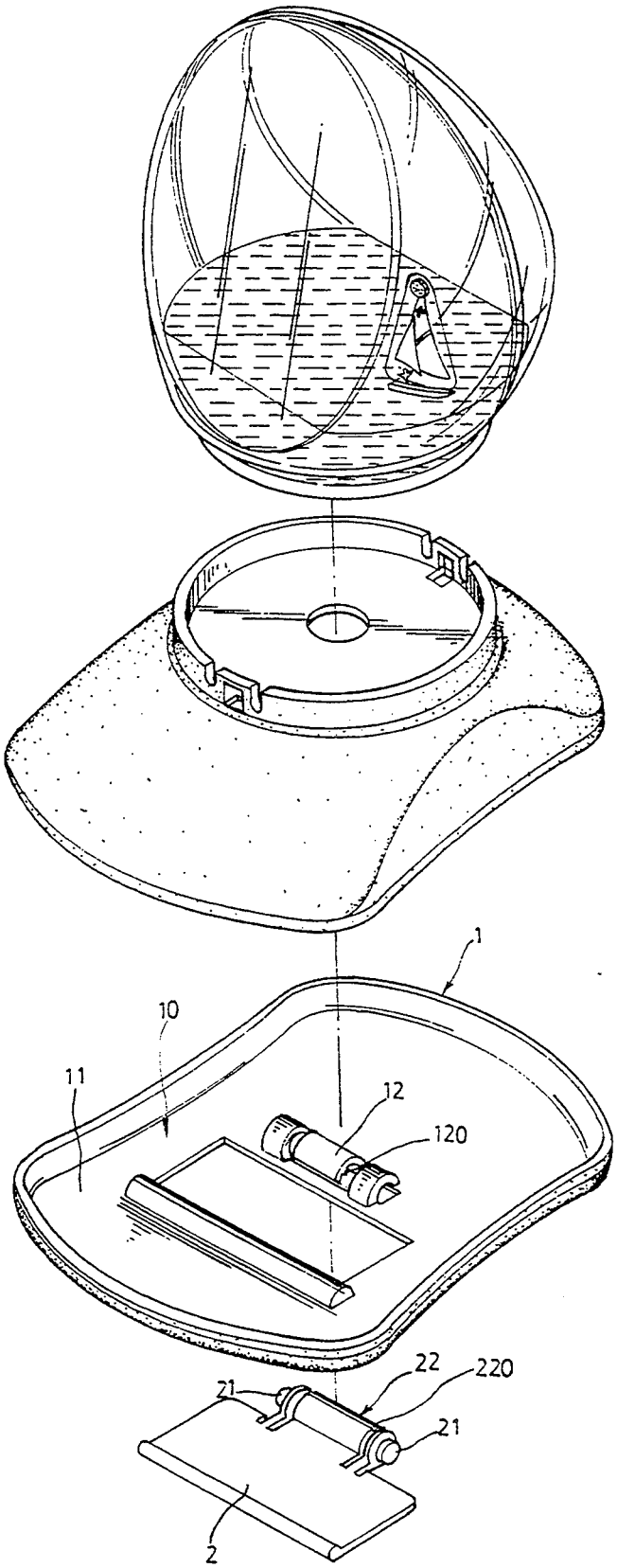
FIG. 2 is an exploded perspective of the liquid-ornamental desk clock of FIG. 1, showing elements of the inclination adjusting means of the present invention.
Figure 3:
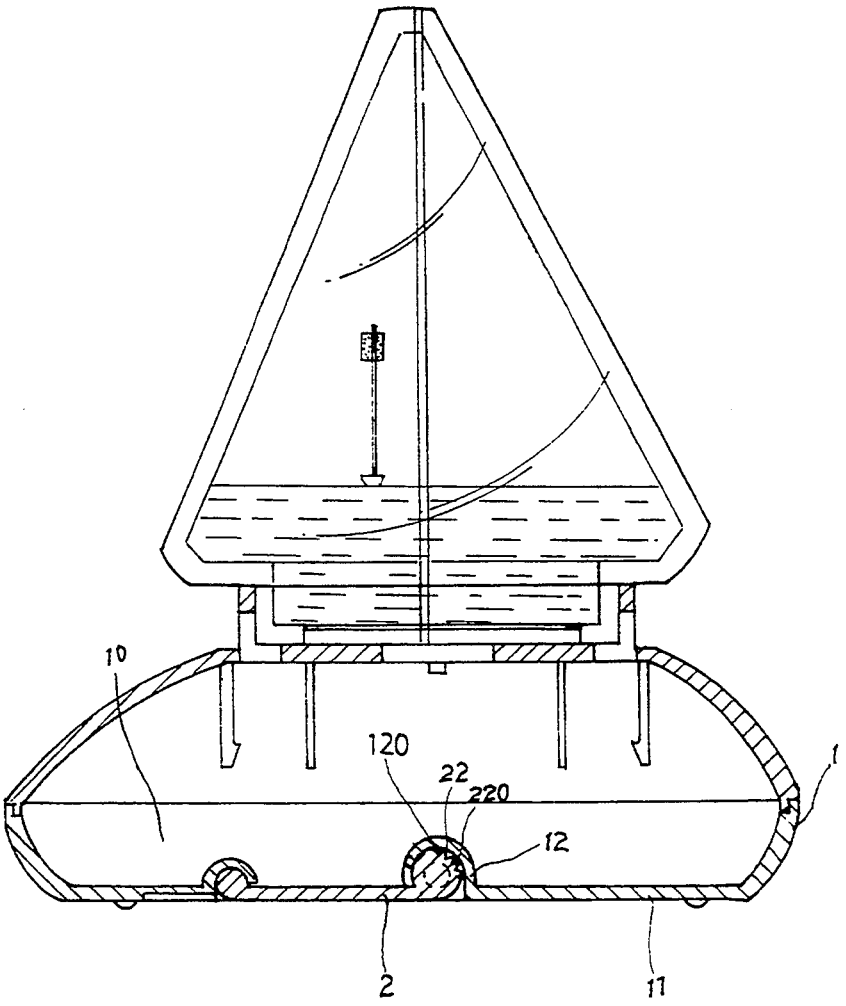
FIG. 3 is a side elevational, sectional view of FIG. 1.

Please refer to FIGS. 1 and 2. A liquid-ornamental desk clock has a base 1 defining a power-supply compartment 10 therein, and a transparent liquid container, preferably made of glass, fixedly attached to a top of the base 1. A bottom floor 11 of the base 1 is provided with an access hole to which a movable cover plate 2 can be closed. The movable cover plate 2 is formed at one side, usually the side facing a rear part of the desk clock, with two slightly springy arms 21 extending toward the rear side of the desk clock. A round bar-shaped rack 22 is integrally formed with the two arms 21 by injection molding such that the rack 22 transversely extends between the two arms 21. A plurality of axially and parallelly extended grooves 220 with adequate depth and pitch are formed on the circumferential surface of the rack 22 at a top and a rear portions thereof. A receiving portion having a substantially semi-circular cross section is formed on the bottom floor 11 of the base 1 with its opening facing downward. The position and the inner profile of the semi-circular receiving portion are so designed that it will fitly receive the arms 21 and the rack 22 of the movable cover plate 2 when the latter is put to close the access hole on the bottom floor 11 of the base 1, and allows the movable cover plate 2 to pivotly swing relative to the receiving portion. A middle section 12 of the receiving portion is separated from two end portions thereof. The middle section 12 is slightly springy and has an axially extended tooth 120 formed at its inner periphery, such that the tooth 120 of the middle section 12 fitly engages into the grooves 220 of the rack 22. When the movable cover plate 2 is not in use but closes the access hole of the bottom floor 11, the cover plate 2 is retained unmoved by the engagement of its grooves 220 with the tooth 120 of the middle section 12 of the receiving portion. When the movable cover plate 2 is pivotly swung downward or outward relative to the receiving portion to obliquely extend out of the bottom floor 11 under a minor pull force, the middle section 12 is accordingly slightly lifted to allow the tooth 120 thereof to disengage from the grooves 220 of the rack 22 until the cover plate 2 is swung to a desirable position and the tooth 120 again engage with the grooves 220. As shown in FIG. 3, the movable cover plate 2 is closed to the access hole of the bottom floor 11 with the two arms 21 and the rack 22 being pivotly received in the receiving portion and the tooth 120 engaging with the grooves 220.

Figure 4:
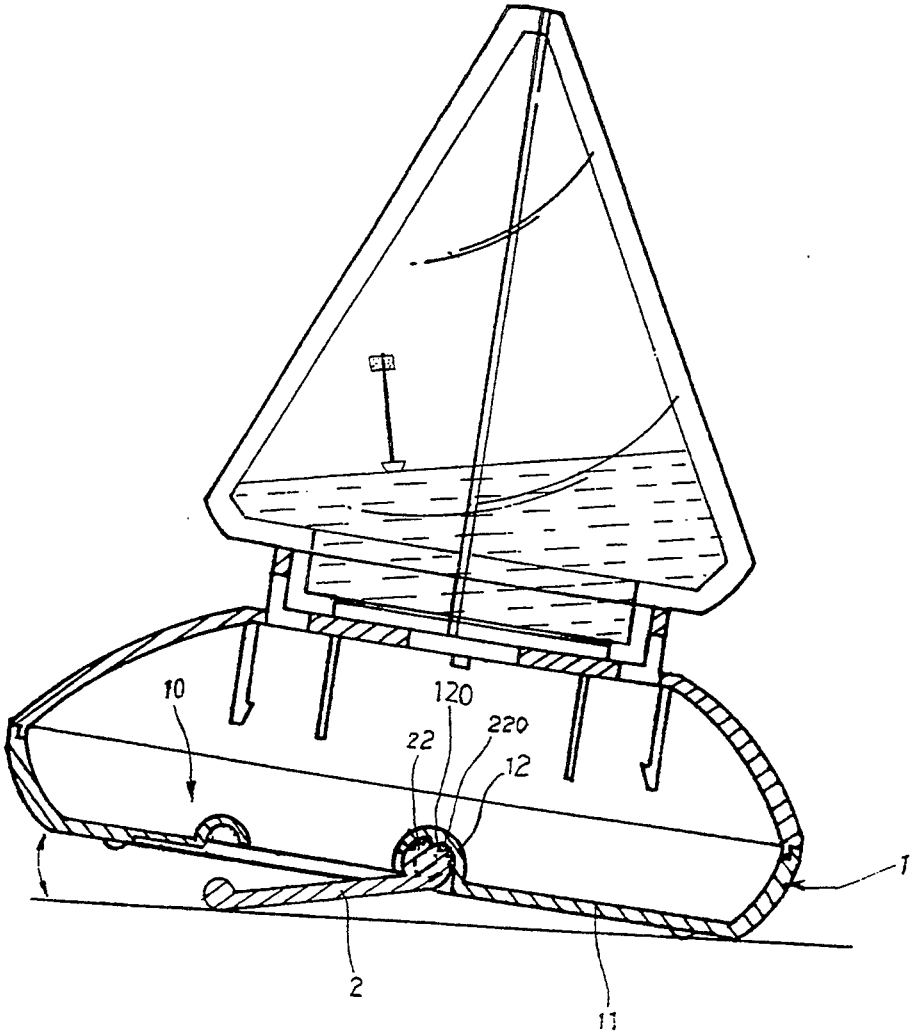
FIG. 4 is similar to FIG. 3 with the movable cover plate of the present invention swung to a certain desired angle and thereby inclining the liquid-ornamental desk clock.

As shown in FIG. 4, when the inclination of the liquid-ornamental desk clock needs adjustment to clearly reflect the dial on the glass container surface, just exert a minor force to pull a free side of the cover plate 2 out of the bottom floor 11, allowing the other side thereof to pivot within the receiving portion until the tooth 120 and the grooves 220 engage with one another at a new position to locate the cover plates 2 at a position that will favorably allow the time indication to be reflected on an outer surface of the glass liquid container.

Figure 5:
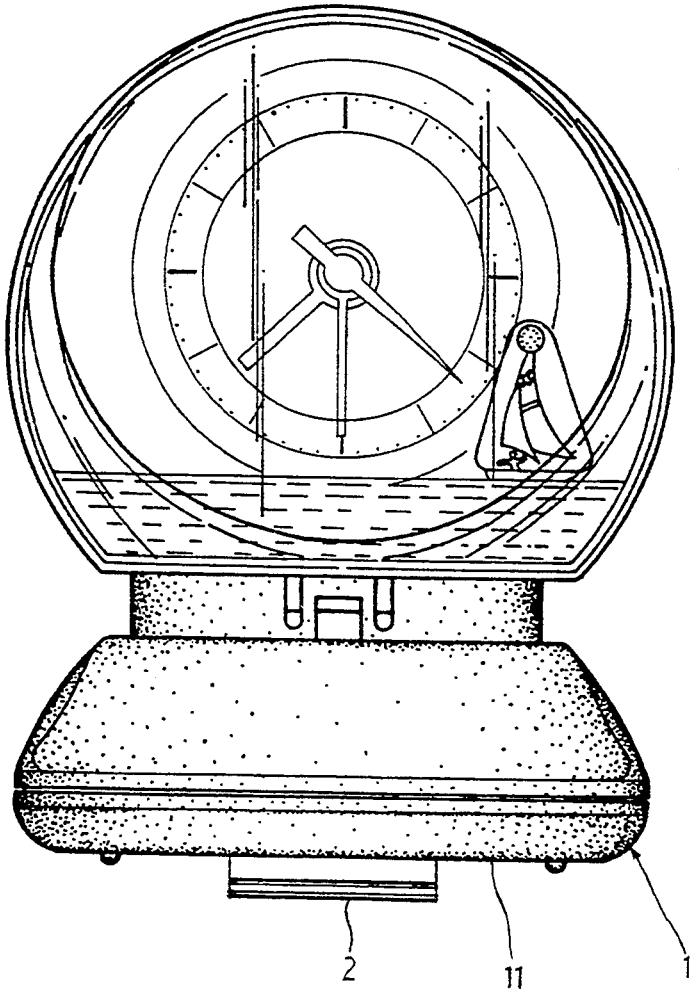
FIG. 5 is a front elevational view of FIG. 1, in which the movable cover plate of the present invention is swung down to inclinedly support the liquid-ornamental desk clock with the time indication clearly reflected on the surface of the glass container of liquid.

As shown in FIG. 5, since the movable cover plate 2 can be easily and freely adjusted to have many different inclinations through the engagement of the tooth 120 with grooves 220 at any position on the rack 22, the liquid-ornamental desk clock is accordingly freely inclined to exhibit changeful view for any user to enjoy from different angles.

What is claimed is:

1. An inclination adjusting means for a liquid-ornamental desk clock which mainly includes a base defining a lower power-supply compartment, and a transparent liquid container disposed above and fixedly attached to said base; said inclination adjusting means comprising a movable cover plate suitable for closing an access hole formed on a bottom floor of said base, and a receiving portion provided on said bottom floor of said base near a rear side of said access hole; said movable cover plate having two slightly springy arms backward extended from a rear edge thereof to hold an integrally injection molded horizontal rack therebetween; and said receiving portion being substantially semi-circular in its cross section to fitly receive said springy arms and said horizontal rack therein, allowing said movable cover plate to be pivotly swung relative to said receiving portion.

2. An inclination adjusting means for a liquid-ornamental desk clock as claimed in claim 1, wherein said horizontal rack has a plurality of axially and parallel extended grooves formed on a circumferential surface near a top and a rear portions thereof.

3. An inclination adjusting means for a liquid-ornamental desk clock as claimed in claim 1, wherein said receiving portion has a slightly springy middle section, on an inner periphery of which an axially extended tooth being formed to mesh with said grooves formed on said horizontal rack, permitting said movable cover plate to be freely adjusted and fixed to different inclinations through the engagement of said tooth with said grooves at any position on said rack.

* * * * *